US011673699B2

(12) United States Patent
Jönsson

(10) Patent No.: US 11,673,699 B2
(45) Date of Patent: Jun. 13, 2023

(54) SUPPORT FOR PACKAGING CONTAINER

(71) Applicant: Tetra Laval Holdings & Finance S.A., Pully (CH)

(72) Inventor: Joel Jönsson, Lund (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 755 days.

(21) Appl. No.: 16/322,892

(22) PCT Filed: Jul. 31, 2017

(86) PCT No.: PCT/EP2017/069343
§ 371 (c)(1),
(2) Date: Feb. 1, 2019

(87) PCT Pub. No.: WO2018/024684
PCT Pub. Date: Feb. 8, 2018

(65) Prior Publication Data

US 2021/0380296 A1 Dec. 9, 2021

(30) Foreign Application Priority Data

Aug. 4, 2016 (EP) ..... 16182847

(51) Int. Cl.
*B65B 3/04* (2006.01)
*B65B 43/54* (2006.01)
(Continued)

(52) U.S. Cl.
CPC ..... *B65B 43/54* (2013.01); *B65B 51/00* (2013.01); *B65B 55/08* (2013.01); *B65B 55/10* (2013.01)

(58) Field of Classification Search
CPC .... B65B 3/04; B65B 43/54; B65G 2201/0261
(Continued)

(56) References Cited

U.S. PATENT DOCUMENTS 2,574,157 A 11/1951 August
2,689,076 A 9/1954 Jenkins
(Continued)

FOREIGN PATENT DOCUMENTS

JP S59-19599 2/1984
JP S 61-144008 U 9/1986
(Continued)

OTHER PUBLICATIONS

Extended European Search report received in EP Application No. 16182847.0 dated Feb. 15, 2017.

*Primary Examiner* — Thanh K Truong
*Assistant Examiner* — Patrick B Fry
(74) *Attorney, Agent, or Firm* — Knobbe, Martens, Olson & Bear, LLP

(57) ABSTRACT

A method is described of filling and/or sealing a packaging container. The packaging container can include a packaging laminate and having a top portion and a lower portion including one or more side walls and an open base. The method can include:

supporting the packaging container with the open base uppermost on a support with an upstanding portion, wherein the support engages the top portion of the packaging container and engages part of the one or more side walls via the upstanding portion of the support; and filling the packaging container via its open base and/or sealing the open base of the packaging container, wherein the support ensures dimensional stability of the packaging container during the filling and/or sealing step.

A related apparatus, support and packaging container are also described.

11 Claims, 4 Drawing Sheets

(51) Int. Cl.
*B65B 51/00* (2006.01)
*B65B 55/08* (2006.01)
*B65B 55/10* (2006.01)

(58) Field of Classification Search
USPC ..... 53/467, 469
See application file for complete search history.

(56) References Cited

U.S. PATENT DOCUMENTS

| | | | | |
|---|---|---|---|---|
| 2,987,082 | A | 6/1961 | Schaub | |
| 3,052,340 | A * | 9/1962 | Lyons | B65B 43/52 198/633 |
| 3,390,891 | A | 7/1968 | Albert | |
| 3,675,759 | A | 7/1972 | Koppe | |
| 4,564,139 | A * | 1/1986 | Reil | B65D 47/103 229/5.5 |
| 4,936,442 | A * | 6/1990 | Von Till | B08B 9/42 198/803.15 |
| 5,484,052 | A | 1/1996 | James et al. | |
| 5,687,874 | A * | 11/1997 | Omori | B65B 43/54 220/737 |
| 5,938,107 | A * | 8/1999 | Anchor | B65D 5/064 229/109 |
| 5,975,158 | A | 11/1999 | Gordon | |
| 2002/0099467 | A1 | 7/2002 | Sleep et al. | |
| 2012/0024673 | A1 | 2/2012 | Paskell | |
| 2013/0105038 | A1 | 5/2013 | Swanson | |
| 2021/0380295 | A1 | 12/2021 | Jonsson | |

FOREIGN PATENT DOCUMENTS

| | | | |
|---|---|---|---|
| JP | H 05-54326 | U | 7/1993 |
| JP | H 08-217023 | A | 8/1996 |
| JP | 2003-341620 | | 12/2003 |
| JP | 2004-059014 | | 2/2004 |
| JP | 2005-008268 | | 1/2005 |
| JP | 2012-134026 | | 1/2005 |
| JP | 2007-320646 | A | 12/2007 |
| JP | 2008-074482 | A | 4/2008 |
| JP | 2009-286499 | A | 12/2009 |
| JP | 2010-235206 | | 10/2010 |
| JP | 2013-112374 | A | 6/2013 |
| JP | 2015-020762 | A | 2/2015 |
| WO | WO 2005/087628 | | 9/2005 |
| WO | WO 2008/004932 | | 1/2008 |

* cited by examiner

SUPPORT FOR PACKAGING CONTAINER

The present invention relates to a method of filling and/or sealing a packaging container; an apparatus for conducting the method; a support for use in the method and/or apparatus; and to a packaging container formed by the method.

The applicant markets food packaging containers of the "carton bottle" type under the names TETRA TOP® and TETRA APTIVA®. Containers of this type are described in WO2008/004932 and WO2009/154535 of the applicant. The containers are used for example to package liquid dairy products, juices, nectars and still drinks.

"Carton bottle" containers have a lower portion including base and side walls formed of packaging laminate (also referred to as the "bulb") and a plastics top portion (also referred to as the "dome") including an opening. In some cases a pre-formed opening device such as a screw top is included. Carton bottle containers can combine the advantages of packaging laminate based containers (e.g. use of renewal plant-based materials, good printability) with the advantages of plastics containers (e.g. design freedom in container shape, use of opening devices).

The packaging laminate typically comprises a core layer of paper or paperboard and one or more barrier layers of, for example, plastics (e.g. low density polyethylene LDPE) and/or aluminium foil. A sleeve of packaging laminate is prepared, either from a flat-laid tube-shaped blank or by forming a sheet around a mandrel and induction sealing to form a tube as the lower portion. The plastics top portion may be injection moulded directly onto a sleeve of packaging laminate. Alternatively, the plastics top portion may be pre-formed and sealed to the sleeve of packaging laminate. The plastics is typically a thermoplastic material such as polyethylene or polypropylene (e.g. high density polyethylene HDPE).

After the injection moulding step, the packaging container is conveyed with its open base directed upwards and is filled through the base in a subsequent filling station. The packaging container may be passed through one or several sterilisation stations before filling if required. After the filling step, the open base of the packaging container is folded and sealed to form a filled sealed container having a flat base.

During the filling and sealing steps, the container is supported with the open base uppermost within a sleeve-like cassette. The plastics top portion of the container is supported from beneath by a member referred to as a "volume plate" which engages the cassette. The volume plate contacts the plastics top portion.

Current carton bottles generally have planar and/or convex surfaces. The present applicant has appreciated that it is desirable to form carton bottles of different designs, and in particular to include concave portions.

In a first aspect, the invention relates to a method of filling and/or sealing a packaging container comprising a packaging laminate and having a top portion and a lower portion including one or more side walls and an open base, the method comprising:

- supporting the packaging container with open base uppermost on a support comprising an upstanding portion, wherein the support engages the top portion of the packaging container and engages part of the one or more side walls of the packaging container via the upstanding portion of the support;
- filling the packaging container via its open base and/or sealing the open base of the packaging container, wherein the support ensures dimensional stability of the packaging container during the filling and/or sealing step.

As the skilled person will understand, the term "top portion" and "lower portion" as used herein relate to the normal orientation of the packaging container when filled, sealed and positioned on its closed base. During filling and sealing the container is inverted.

The term "dimensional stability" refers to maintaining the size and shape of the packaging container through filling and/or sealing so that the final container is substantially unchanged in size and shape compared with the container before filing and/or sealing except for its base being closed. In some preferred embodiments, an important aspect of dimensional stability is maintaining the shape of concave portions of the packaging container.

Preferably, the packaging container is filled with liquid food product. Preferred products including liquid dairy products, juices, nectars and still drinks e.g. water and milk drinks.

Preferably, the sealing step involves folding and sealing of packaging laminate using a transverse seal as known to the skilled person.

In a preferred embodiment, the top portion of the packaging container is of plastics and the lower portion of the packaging container is of packaging laminate (i.e. the container is a carton bottle), and the support engages the plastics top portion and the upstanding portion of the support engages part of the side walls(s) of the packaging laminate lower portion. The materials of the carton bottle may generally be as described in connection with known carton bottles above.

Preferably, the top portion includes an opening device (also referred to as a "lid" or "top") e.g. a screw or press fit opening device.

Preferably, the support engages the full perimeter of the top portion of the packaging container e.g. with the contact area forming a ring-like shape. This is useful in preventing rotation of the container.

The term "upstanding" includes a portion which extends in a direction substantially perpendicular to the main body of the support and/or substantially in the axial direction of the support, in particular in the upwards direction in use. Preferably, the upstanding portion of the support is at least one upstanding peg. For example one, two, three or four upstanding pegs may be present. In this and other preferred embodiments, the upstanding portion may engage only a part of the perimeter (around the side walls) of the packaging laminate lower portion. More preferably, the upstanding portion engages one or more corners of the lower portion of the packaging container.

Suitably, the lower portion is formed of a sleeve/tube of packaging laminate. The sleeve will typically have a longitudinal seal. The sleeve may be cylindrical with a constant cross-section e.g. square or rectangular in cross-section. "Cross-section" as used herein refers to a cross-section parallel to the base i.e. horizontal when the container is in the normal orientation supported on its closed base discussed above. A brick-like packaging container has a constant rectangular cross-section. Alternatively the sleeve may have a varying cross-section along its length e.g. it may be frustopyramidal or of a more complicated design.

Preferably, at least part of the lower portion of the packaging container is not rectangular in cross-section. This may be desirable for aesthetic reasons and/or to make the container easier or more comfortable to hold. The packaging container may for example have a rectangular e.g. square base but a non-rectangular cross-section away from the base. It is also preferred for the top portion not to be rectangular in cross-section. 0, 1, 2 or 3 right-angled corners may be present through some or all of the height of the packaging container. "Corner" as used herein refers to a change in direction within a cross-section of the container. Thus, a corner corresponds generally to an edge between side walls. A corner may have a sharp angle (which may be defined by a fold) or be rounded, including having a concave/inwards curve as explained below.

The packaging container may have planar or curved surfaces (including side walls, top and base). The packaging container may have a polyhedral cross-section so as to define multiple side walls e.g. it may be octagonal in cross-section or be of another shape with more than 4 sides. Where the packaging container has a curved cross-section only and no identifiable corners, a single side wall may be present. Curved surfaces of the packaging container may be convex and/or concave.

In a particularly preferred embodiment, the top portion and/or the lower portion of the packaging container comprises a concave portion and the support engages at least part of the concave portion. A concave portion is inwardly curved with respect to the container as a whole. A concave portion may help to make the packaging container easier to hold. Preferably, the concave portion is such that a cross-section of the packaging container has an inward curve. Preferably, the packaging container has a concave portion at one or more corners of the top portion and/or the lower portion; this profile need not extend for the full height of the top or bottom portion. However, a cross-section in the upper surface of the packaging container is also possible. Where a concave portion is present, support during filling and/or sealing is particularly important in ensuring dimensional stability, as explained below.

Alternatively or additionally, the packaging container may have one or more rounded corners in the top portion and/or at least part of the lower portion. Again, this profile need not extend for the full height of the top or bottom portion.

The packaging container may have a larger maximum cross-sectional dimension within its top portion than within its lower portion. The term "maximum cross-sectional dimension" refers to the longest linear distance across any cross-section (as defined above) within the specified portion.

The top portion and lower portion of the packaging container may be separable for recycling.

Preferably, the support is removably mounted to a cassette, the cassette providing further support for the packaging container during the filling and/or sealing step. The cassette is preferably of metal. The cassette may be cylindrical in shape, and may be a sleeve with the packaging container being inserted in use into the cassette, e.g. from above, and being held in place by friction fit. This is in contrast to the support which supports the packaging container from underneath. In some cases the packaging container may be loosely held within the cassette.

The cassette may comprise mounting means for the support e.g. rails. The cassette may have more than one mounting means such that the support can be mounted at different positions. The method may include steps of mounting the support to the cassette and/or removing the support from the cassette.

In a second aspect, the invention relates to an apparatus for use in a method as described above, the apparatus comprising:

a cassette for supporting the packaging container with open base uppermost;

a support removably mounted to the cassette, wherein the support comprises an upstanding portion and is adapted to engage the top portion of the packaging container and to engage part of the one or more side walls of the packaging container via the upstanding portion of the support;

apparatus for filling the packaging container via its open base and/or sealing the open base of the packaging container.

In a third aspect, the invention relates to a support for use in the method and/or apparatus described above, comprising:

a support portion including an upstanding portion, the support portion being adapted to engage the top portion of the packaging container and to engage part of the one or more side walls of the packaging container via the upstanding portion of the support; and a mounting for engaging a cassette.

Preferably the support is formed in a single piece. The support may be prepared by additive manufacturing (3D printing) or by moulding or casting. Preferably, the support is formed of polyoxymethylene (POM) or POE (polyoxyethylene)

The support portion may be in the form of a collar. The collar may include a ring from which the upstanding portion extends. As mentioned above, the upstanding portion is preferably a peg. The peg preferably has a convex cross-sectional profile towards the centre of the collar (i.e. where it will engage the packaging container) so as to complement a concave portion of the packaging container. The peg may have a straight, concave or convex cross-sectional profile toward the outside of the collar. For example, the peg may be oval in cross-section.

The mounting may comprise any suitable arrangement for removing engagement with the cassette. One example of the mounting is legs which co-operate with rails of the cassette.

The support may further comprise a grip member.

In a fourth aspect, the invention relates to a carton bottle having a concave portion, the carton bottle being obtainable by a method according to the invention.

All features described in connection with any aspect of the invention can be used with any other aspect of the invention.

The invention will be further described with reference to a preferred embodiment, as shown in the drawings in which:

FIG. 3(*b*) shows a perspective view of a support insert 142 of an alternative embodiment of the invention.

Figure 1:
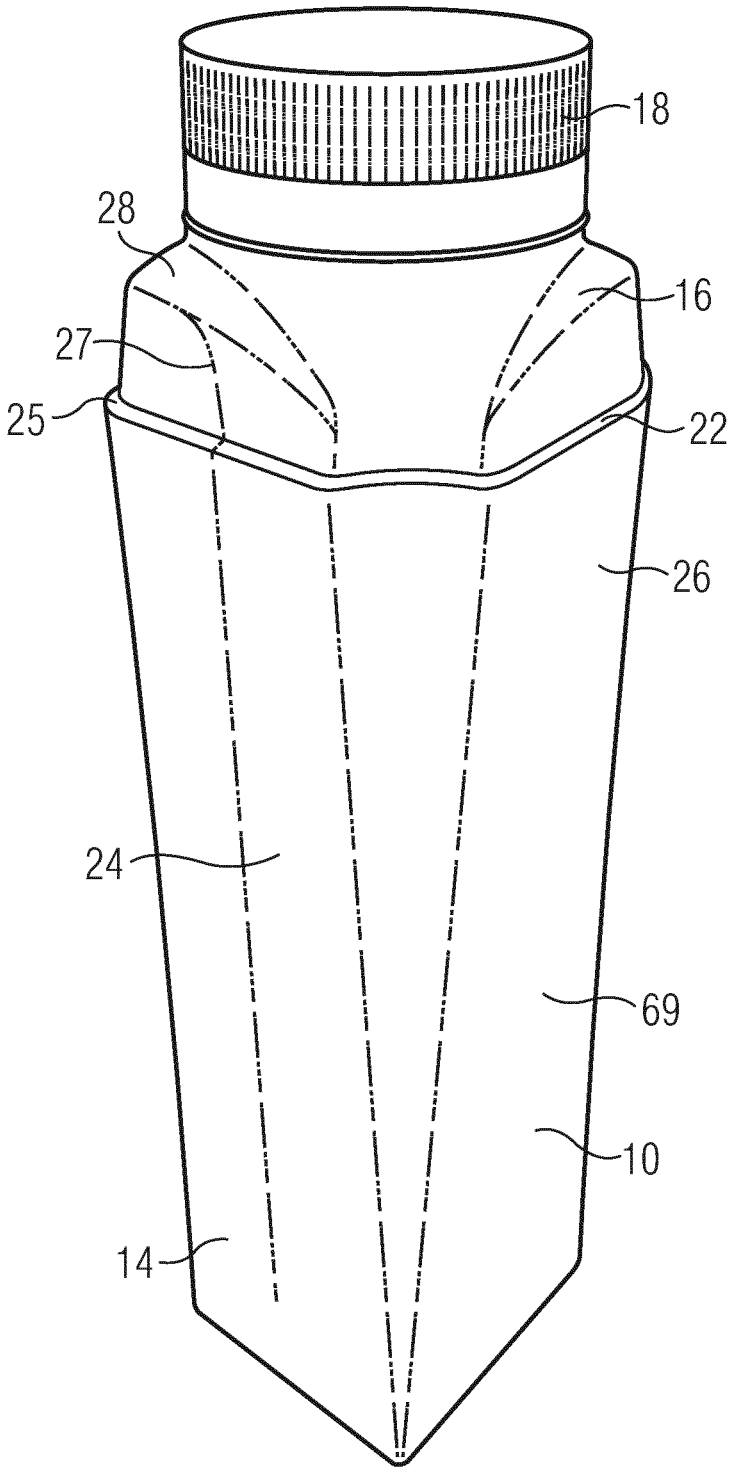
FIG. 1 shows the filled and sealed carton bottle 10 of a preferred embodiment of the invention.
Figure 2:
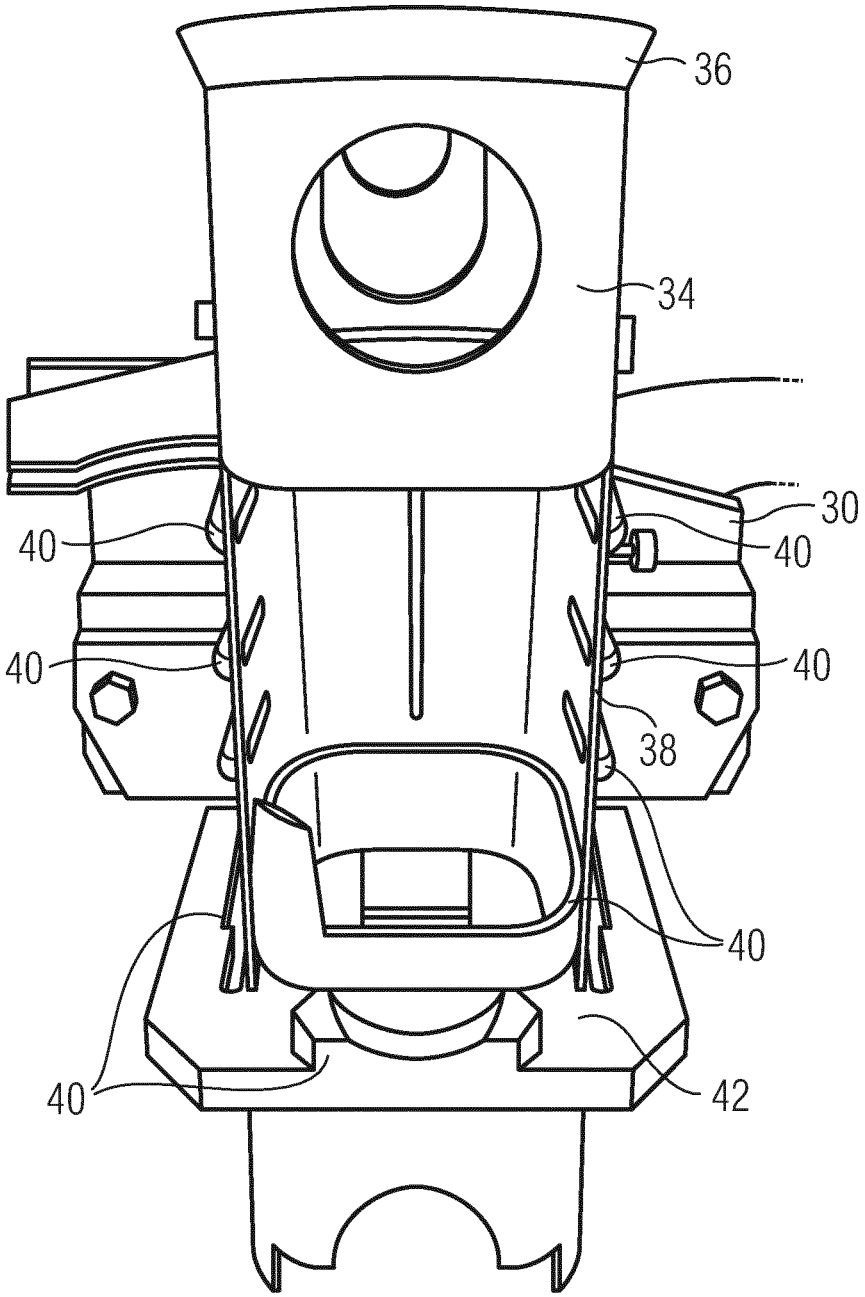
FIG. 2 shows a cassette 30 and support insert 42 forming part of a filling and sealing apparatus of the preferred embodiment of the invention.
Figure 5:
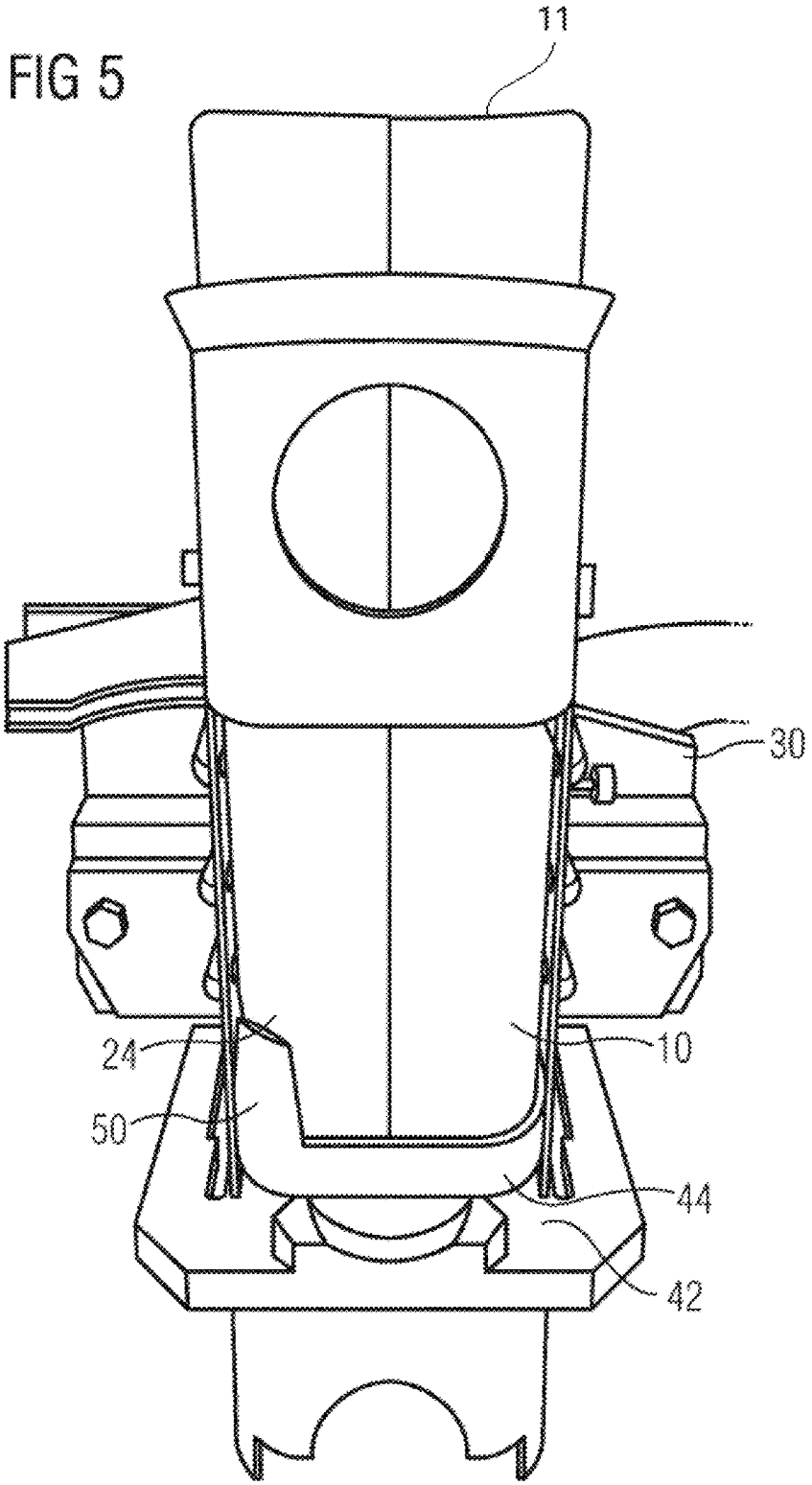

FIG. 5 shows the cassette 30 and support insert 42 of FIG. 2 supporting the filled and sealed carton bottle 10 of FIG. 1.

ATT/3™ filling and sealing apparatus (not shown) is used to fill and seal a carton bottle 10 (also referred to herein as a "packaging container") prepared as described above.

The carton bottle 10 (FIG. 1) has a lower portion formed of a sleeve of packaging laminate 14 and a plastics top portion 16 including a screw top opening device 18. The sleeve of packaging laminate 14 will form the side walls 69 and closed base (not shown) of the final filled and sealed package as described in more detail below. The sleeve of packaging laminate 14 has a lower end (not shown) which is square in cross-section and an upper end 22 which is generally square in cross-section with rounded corners; at one corner 24 is a concave channel 26 starting near to the lower end and extending and widening to the upper end 22. The cross-sectional dimensions of the sleeve of packaging laminate 14 at the upper end 22 are larger than at the lower end. The plastics top portion 16 is moulded and joins the sleeve of packaging laminate 14 at a seam 25. The plastics top portion 16 generally extends the cross-section of the packaging laminate sleeve 14 including the concave channel 26 (also referred to herein as a "concave portion") via a shoulder region 27 to an upper surface 28 including an opening with screw threaded neck (not shown) to which the screw top opening device 18 is mounted.

The carton bottle 10 is formed up to the filling and sealing steps by the method described above.

The filling and sealing apparatus includes a metal cassette 30 (FIG. 2) for conveying the carton bottle 10 with open base (not shown) uppermost. The cassette 30 comprises a cylindrical upper surround 34 with a flanged top edge 36 and a lower frame 38 having a C-shaped cross-section and being provided with several pairs of external rails 40 spaced along its height. The cassette 30 is sized such that a carton bottle 10 introduced into the cassette 30 via its flanged top edge 36 will be engaged by friction fit with the cylindrical upper surround 34 of the cassette 30.

Figure 3:
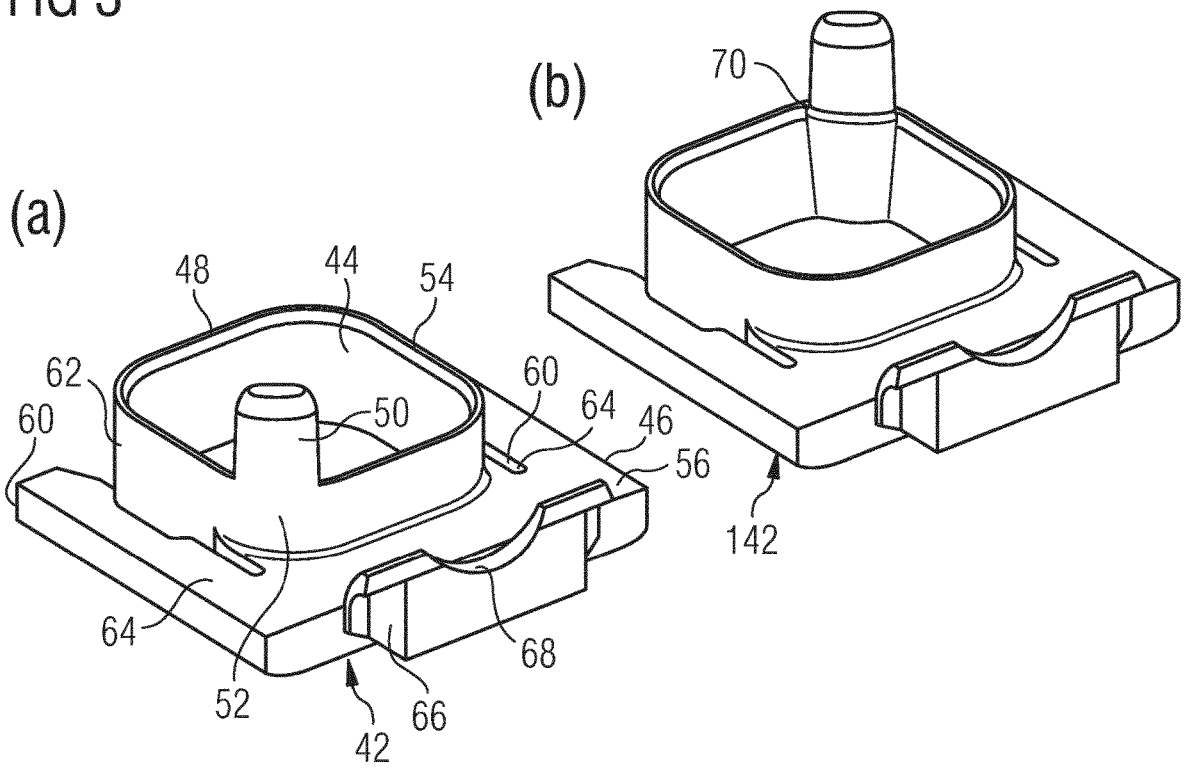
FIG. 3(*a*) shows a perspective view of the support insert 42 of a preferred embodiment of the invention.
Figure 4:
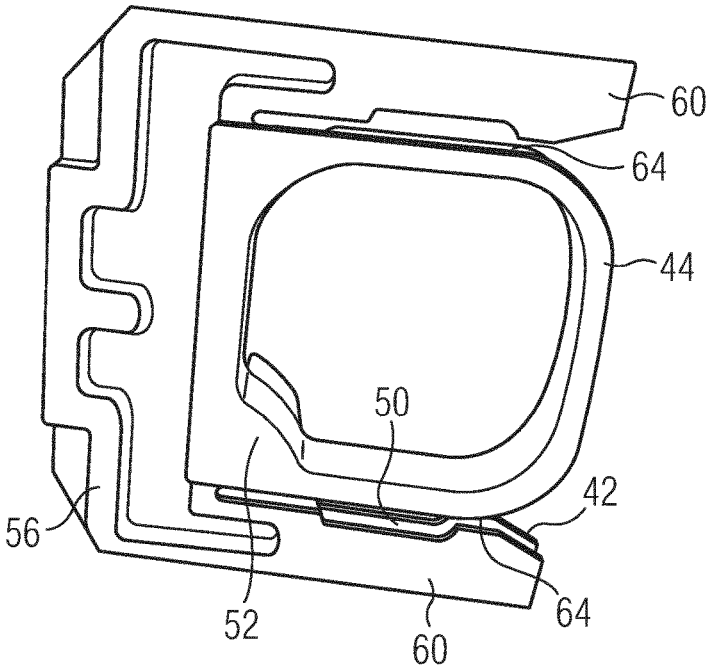
FIG. 4 shows the support insert 42 of FIG. 3(*a*) from below.

A support insert 42 (FIGS. 3(*a*) and 4); also referred to herein as a "support" and as a "volume plate") is mounted to the rails 40 of the cassette 30.

The support insert 42 is formed in one piece of POM by three-dimensional printing. The support insert 42 includes a collar 44 (also referred to herein as a "support part") for supporting the carton bottle 10 and a mounting 46. The collar 44 is in the form of a ring 48 which is approximately cylindrical but which narrows slightly in the downwards direction. The ring 48 is generally square with rounded corners; one corner 52 (front left in use when facing the apparatus) is concave and an upstanding peg 50 (also referred to herein as an "upstanding portion") of oval cross-section protrudes perpendicular from this corner 42 perpendicular to the ring 48 in the upwards direction so as to extend the concave profile. The inner profile 54 of the collar 44 is complementary to part of the outside profile of the carton bottle 10 such that when the carton bottle 10 is positioned on the collar 44 with its plastics top portion 16 downwards, the collar 44 engages the shoulder region 27 but not the upper surface 28 or opening device 18 of the plastics top portion 16. The collar 44 also engages part of the packaging laminate sleeve 14. More specifically, corner 52 engages the concave channel 26 of the plastics top portion 16 and upstanding peg 50 engages part of the length of the concave channel 26 of the packaging laminate sleeve 14.

The mounting 46 of the support insert 42 takes the form of an integral mounting plate extending from the lower front edge (in use) of the collar 44 with a pair of legs 60 extending therefrom along the sides 62 of the collar 44; the legs 60 are separated from the collar 44 by a pair of slots 64. The front edge (in use) of the mounting plate 56 extends upwards into a grip member 66 having a semi-circular notch 68.

In use, the support insert 42 is mounted to the cassette 30 by hand using grip member 66. The slots 64 of the mounting 46 are slidably engaged with the C-shaped lower frame 38 of the cassette 30 such that the legs 60 are supported on one of the pairs of rails 40.

A carton bottle 10 with open base 11 uppermost is introduced into the cassette 30 via the flanged top edge 36 of the cassette 30 (FIG. 5). The top portion 16 of the carton bottle 10 is engaged by friction fit with the cylindrical upper surround 34 of the cassette 30. However, the packaging laminate sleeve 14, of smaller cross-sectional dimensions, sits within the cylindrical upper surround 34 of the cassette 30 without close engagement.

The carton bottle 10 is orientated such that the concave channel 26 is aligned with the concave front corner 52 of the support insert 42 which has the upstanding peg 50. Thus, the collar 44 of the support insert 42 engages the carton bottle 10, with the ring 48 engaging the full perimeter of the plastics top portion 16 at the shoulder region 27 and the upstanding peg 50 engaging only the concave channel 26 of the packaging laminate sleeve 14. The opening device 18 does not contact the support insert 42. The open base of the packaging laminate sleeve 14 is held within the cylindrical upper surround 34 of the cassette 30. The carton bottle 10 is thus well supported, particularly at its concave portions. The carton bottle 10 is prevented from rotating or moving vertically within the cassette 30.

The carton bottle 10 is conveyed by cassette 30 to a filling station (not shown) and is filled through its open base with liquid food product (not shown). The support insert 42 provides counter pressure against the pressure of the filling liquid. This prevents filling from changing the shape of the carton bottle 10 by bulging, particularly at the concave channel 26. In this way, dimensional stability of the carton bottle 10 is ensured.

The filled carton bottle 10 is conveyed by cassette 30 to a sealing station (not shown) and the open base is sealed with a transverse seal (not shown) and folded. Thus, side walls 69 and a closed base (not shown) are formed. Again, the support insert 42 provides counter pressure against the pressure of the liquid contents during volume displacement which may occur during sealing. This prevents sealing from changing the shape of the container by bulging, particularly at the concave channel 26. In this way, dimensional stability of the carton bottle 10 is ensured.

In an alternative embodiment of the support insert 42 shown in FIG. 3(*b*), upstanding peg 50 extends from a rear corner (in use) 70 of the support insert 142.

The use of a support insert as in the preferred embodiments of the invention has the following advantages:

- The carton bottle is well supported externally by the support insert during filling and sealing. This support extends to the packaging laminate lower portion of the carton bottle via the upstanding peg, as well as to the plastics top portion. Thus, changes in internal pressure in the carton bottle during filling and sealing are counteracted by external supporting pressure. This prevents bulging or other changes to the shape of the container, which would otherwise be a particular risk at the concave portion.
- The support insert has a complementary profile to the plastics top portion of the carton bottle. This prevents the carton bottle from rotating within the cassette. This is particularly important as the carton bottle has rounded corners. It is also particularly important as the carton bottle has smaller cross-sectional dimensions at its base than at its top portion, so that the cassette does not fit tightly around the lower portion.
- The support insert serves to position the carton bottle at the correct height within the cassette during the filling and sealing steps. The support insert may be positioned at different heights by appropriate selection of one of the sets of rails of the cassette. This allows flexibility, for example for carton bottles of similar top design but different volumes.

The use of a support insert which is separable from the cassette means that the filling and sealing apparatus can be easily customised for different designs of carton bottle by use of different supports.

The ability to form carton bottles with one or more concave portions is desirable as it provides additional design freedom. Such bottles are easy to hold. They may be desirable for aesthetic reasons. It will be seen that the carton bottle of FIG. 1 has an unusual appearance and can readily be gripped with the user's thumb in the concave channel e.g. during opening.

Whilst the invention has been described with reference to a preferred embodiment, it will be appreciated that various modifications are possible within the scope of the invention.

10 carton bottle container
14 sleeve of packaging laminate
16 plastics top portion
18 screw top opening device
22 upper end of sleeve of packaging laminate
24 corner of sleeve of packaging laminate
25 carton bottle seam
26 concave channel
27 shoulder region of plastics top portion
28 upper surface of top portion
30 cassette
34 cylindrical upper surround of cassette
36 flanged top edge of cassette
38 lower frame of cassette
40 rails of cassette
42 support insert
44 collar
46 mounting
48 ring of collar
50 upstanding peg of collar
52 front corner of ring of collar
54 inner profile of collar
56 mounting plate
60 legs of mounting
62 sides of collar
64 slots of support insert
66 grip member of support insert
68 semi-circular notch of grip member
69 side walls of carton bottle
70 rear corner of ring of collar
142 support insert of alternative embodiment

The invention claimed is:

1. A method of filling and/or sealing a packaging container comprising a packaging laminate and having a top portion and a lower portion including one or more side walls and an open base, the method comprising:

supporting the packaging container with the open base uppermost on a support comprising an upstanding portion, wherein the support engages the top portion of the packaging container and engages part of the one or more side walls via the upstanding portion of the support;

filling the packaging container via its open base and/or sealing the open base of the packaging container, wherein the support ensures dimensional stability of the packaging container during the filling and/or sealing step; and wherein the support comprises a collar configured to engage a full perimeter of the packaging container, the collar comprising a generally square opening with rounded corners, the upstanding portion protruding from a corner of the collar, the corner of the collar extending into the opening of the collar.

2. The method of claim 1, wherein the top portion of the packaging container is plastic and the lower portion of the packaging container packaging laminate, and wherein the support engages the plastic top portion and the upstanding portion of the support engages part of the one or more side walls of the packaging laminate lower portion.

3. The method of claim 1, wherein the upstanding portion of the support engages one or more corners of the lower portion of the packaging container.

4. The method of claim 1, wherein the top portion and/or at least part of the lower portion of the packaging container is not rectangular in cross-section.

5. The method of claim 4, wherein the packaging container has one or more rounded corners in the top portion and/or at least part of the lower portion.

6. The method of claim 1, wherein the top portion and/or the lower portion of the packaging container comprises a concave portion and the support engages at least part of the concave portion.

7. The method of claim 6, wherein the packaging container has a concave portion at one or more corners of the top portion and/or the lower portion.

8. The method of claim 1, wherein the packaging container has a larger maximum cross-sectional dimension within its top portion than within its lower portion.

9. The method of claim 1, wherein the support is removably mounted to a cassette, the cassette providing further support for the packaging container during the filling and/or sealing step.

10. The method of claim 1, wherein the inner diameter of the collar narrows in a downward direction.

11. A packaging container having a concave portion, the packaging container being produced by the method of claim 1.

* * * * *